US005284075A

United States Patent [19]

Strauch et al.

[11] Patent Number: 5,284,075

[45] Date of Patent: Feb. 8, 1994

[54] SCREWING TOOL, PARTICULARLY A SCREWDRIVER

[75] Inventors: Martin Strauch, Wuppertal; Andreas Reusch, Remscheid, both of Fed. Rep. of Germany

[73] Assignee: Wera Werk Hermann Werner GmbH & Co., Wuppertal, Fed. Rep. of Germany

[21] Appl. No.: 866,319

[22] Filed: Apr. 9, 1992

[30] Foreign Application Priority Data

May 2, 1991 [DE] Fed. Rep. of Germany ... 9105419[U]
Sep. 3, 1991 [DE] Fed. Rep. of Germany ... 9110904[U]

[51] Int. Cl.[5] ..... B25B 13/48
[52] U.S. Cl. ..... 81/436; 81/460
[58] Field of Search ..... 81/436, 460, 461, 900

[56] References Cited

U.S. PATENT DOCUMENTS

| | | | |
|---|---|---|---|
| 2,083,092 | 6/1937 | Richer . | |
| 2,193,477 | 3/1940 | DeVellier | 81/436 |
| 3,120,251 | 2/1964 | York | 81/436 |
| 3,498,173 | 3/1970 | Wright | 81/436 |
| 4,060,115 | 11/1977 | Bocanegra Marquina | 81/436 |
| 4,269,246 | 5/1981 | Larson et al. | 81/460 |
| 4,338,835 | 7/1982 | Simons . | |
| 4,625,598 | 12/1986 | Wolfram | 81/436 |
| 4,938,731 | 7/1990 | Nguyen et al. | 81/460 |
| 4,970,922 | 11/1990 | Krivec | 81/460 |

FOREIGN PATENT DOCUMENTS

| | | | |
|---|---|---|---|
| 0442511 | 8/1991 | European Pat. Off. . | |
| 3120216 | 12/1982 | Fed. Rep. of Germany . | |
| 3206494 | 9/1983 | Fed. Rep. of Germany . | |
| 8519877 | 10/1985 | Fed. Rep. of Germany . | |
| 2383350 | 10/1978 | France . | |
| 2063743 | 7/1981 | United Kingdom | 81/900 |

*Primary Examiner*—James G. Smith
*Attorney, Agent, or Firm*—Martin A. Farber

[57] ABSTRACT

A screwing tool, particularly a screwdriver (1) or screwdriver bit, for polygonal socket screws (8), having flank sections (12) which are convex in circumferential direction; in order to optimize the transmission of force it is proposed that the flank sections (12, 12') be interrupted in the central region of each flank (11) by a non-convexly extending intermediate section (13/13').

10 Claims, 11 Drawing Sheets

SCREWING TOOL, PARTICULARLY A SCREWDRIVER

FIELD AND BACKGROUND OF THE INVENTION

The present invention relates to a screwing tool.

A screwing tool for polygon socket screws is known from Federal Republic of Germany 32 06 494 A1 in which two adjacent polygon corners are connected by two convex flank sections forming a gusset in the central region of each flank. Since said gusset is set back with respect to a tangent to the convex flank sections, the force application surface is reduced together with the fact that furthermore only a reduced torque can be transmitted. Due to its notch effect the gusset in particular weakens the transmission stability of the screwing tool.

SUMMARY OF THE INVENTION

The object of the invention is so to develop an easily manufactured screwing tool of the type in question in that optimal torques can be transmitted as compared with the size of the screwing tool.

This object is achieved in a screwing tool of this type by the fact that the convexly extending flank section (12, 12') are separated from each other in the central region of each flank (11) by a non-convexly extending intermediate section (13/13').

As a result of this development there is obtained a screwing tool of increased utility and use, particularly a screwdriver for polygon socket screws, particularly hexagon socket screws.

Optimal torques in proportion to the size of the screwing tool or its working end can be transmitted with little wear. This is due to the fact that the convexly extending flank sections are separated from each other in the central region of each flank by a non-convexly extending intermediate section. Furthermore, there is a special arrangement of the polygon-corner ends of the convexly extending sections with respect to the linear extension of the two end points of the intermediate section or the tangent to them. This means, that when the screwing tool placed in action and a torque is exerted, a convexly extending flank section of each flank and the non-convexly extending intermediate section of each flank or a partial length thereof comes against the corresponding hexagon socket surface of the screw. There are optimal lever arms for the regions of the introduction of the force. As the torque becomes greater, a continuously larger resting surface is obtained as a result of the deformation on the screwhead, combined with the aforementioned optimal transmission of a torque. As a result of the continuously increasing supporting surface, a "cam-out effect" is also counteracted; this means that the working end of the screwing tool, in particular a screwdriver, remains in engagement with the polygonal socket of the screw. As a result of the setback of the polygon corner ends, a convenient introduction of the working end into the polygonal socket is made possible even if the corners thereof are slightly rounded as a result of manufacturing tolerances. The result is therefore always obtained that the convexly extending flank sections of the flanks and the non-convexly directed intermediate sections come to rest against the polygonal surfaces of the polygon socket. As a result of the non-convexly extending or even concave intermediate sections between the convex flank sections of each other flank, corners of an obtuse angle close to 180° result, which in combination with the polygon-corner ends produce an 18-sided polygon from a hexagon. The convexly extending flank sections are formed by arcs which extend above the connecting line between the corners of the intermediate sections and the polygon-corner ends. It has been found advantageous for the intermediate sections to be linear. This also favors simple manufacture of the working end of the screwing tool. For good transmission of torque, it is also advantageous for each convexly extending flank section to be more than twice the length of the intermediate section. In the case of a screwdriver for hexagon socket screws a ratio between flank section and intermediate section of 4:1 is advisable. Plus or minus deviations are possible. It should furthermore be emphasized that the linear intermediate section extends tangentially to the adjacent end region of both convex flank sections. In the case of a concave intermediate section, approximately the same length of all arc sections is advantageous. The intermediate section can possibly be formed by a fillet which is filled with diamond particles. Sliding of the work end out of the polygon socket is therefore further counteracted. However, there is also the possibility of providing both the flank sections and the intermediate sections with a coating of diamond particles. This can be done in the manner that a diamond powder with the range of about 15 μm is added to the galvanization bath. Together with the coating, one also obtains a reduction in wear of the working end.

BRIEF DESCRIPTION OF THE DRAWINGS

One embodiment of the invention will be explained below with reference to the drawing, in which.

DETAILED DESCRIPTION OF THE PREFERRED EMBODIMENT

Figure 1:
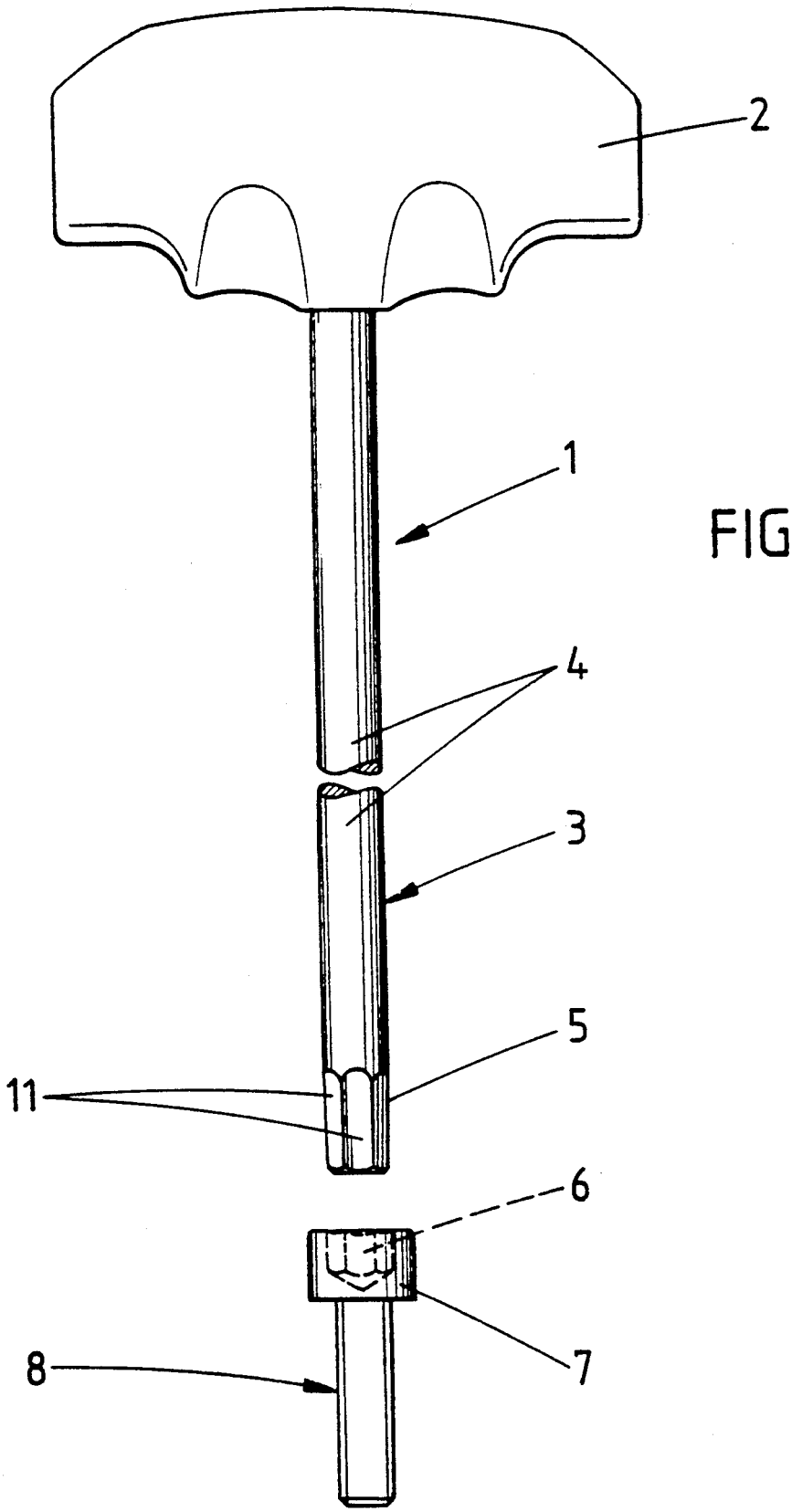
FIG. 1 shows a screwdriver for hexagon socket screws and a hexagon socket screw arranged coaxially thereto seen in elevation.
Figure 2:
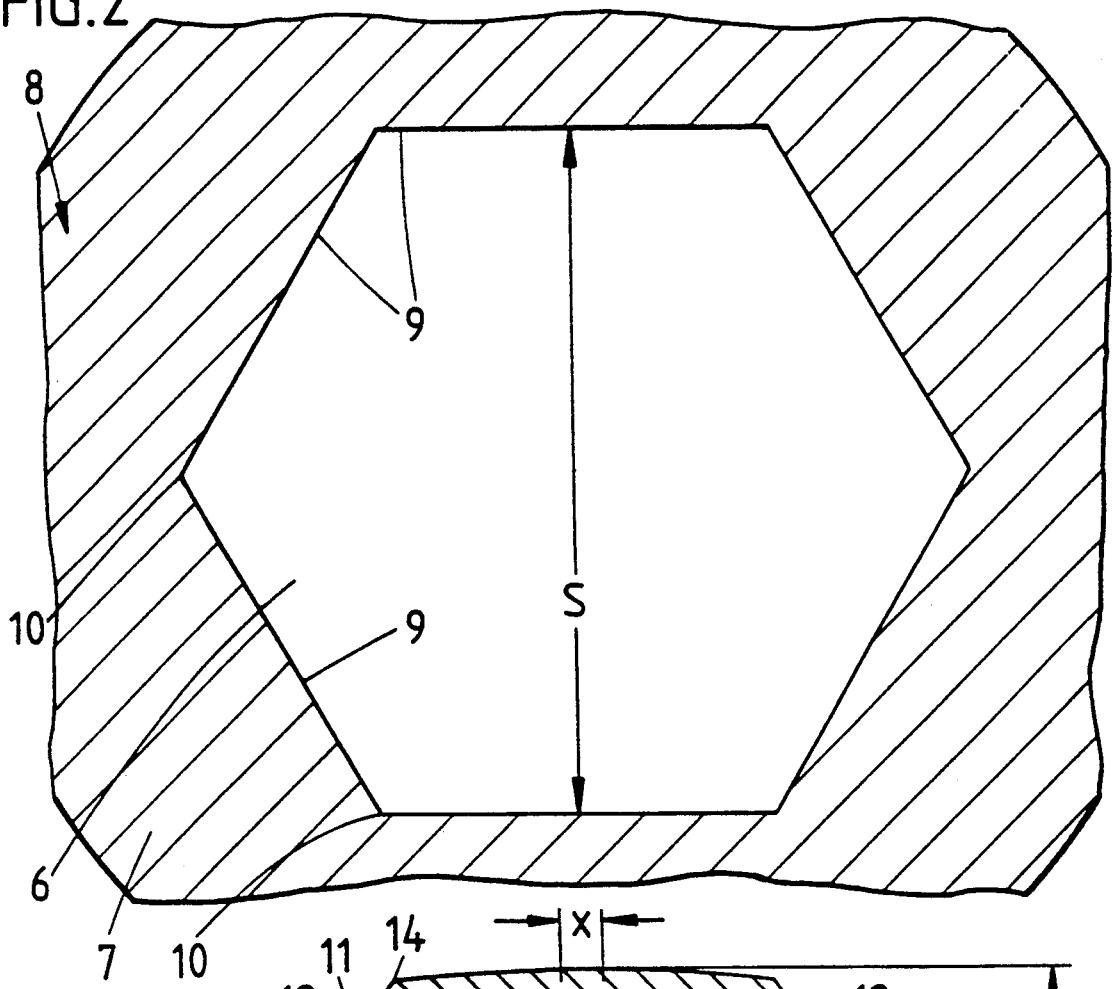
FIG. 2 shows, greatly enlarged, a cross section through the screwhead in the region of the hexagon socket.
Figure 3:
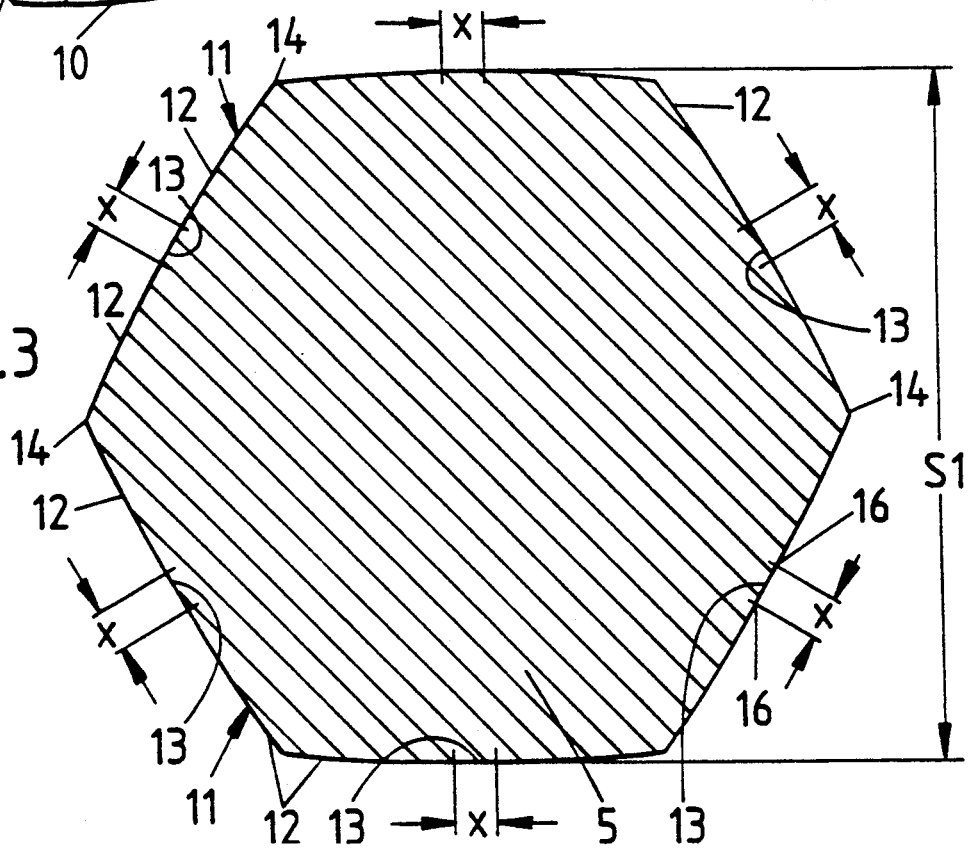
FIG. 3 shows, also greatly enlarged, a cross section through the working end of the screwdriver.

The screwdriver 1 shown in FIG. 1 has a handle 2 with, embedded in it, a blade 3 which is non-turnable with respect to the handle. The blade has a shank 4 which is cylindrical in cross section and has a solid hexagon 5 on its end. This hexagon represents the work end of the screwdriver 1 and is adapted to extend into the hexagon socket 6 of the screwhead 7 of a hexagon socket screw 8.

In detail, the hexagon socket 6 is formed of the linear hexagon socket surfaces 9, in the manner that two hexagon socket surfaces meet in an edge 10. The distance between two opposite hexagon socket surfaces 9 extending parallel to each other is the distance across flats S.

While linear hexagon socket surfaces 9 are present on the screw 8, the solid polygon 5 has on each flank 11 two convexly extending flank surfaces 12 which, in the middle region of the flank 11, are separated by a non-convexly extending intermediate section 13. Furthermore, the polygon- corner ends 14 of the convexly extending flank sections 12 are arranged set back with respect to the linear extension 15 of the two end points 16 of the intermediate section 13; see, in particular, FIG. 5. As a result of the adjoining convex flank sections 12 the end points 16 in a certain respect form corner points 12, so that with a hexagonal working end in combination with the polygon-corner ends 14 an 18-sided polygon results.

The convexly extending flank sections 12 extend beyond the connecting lines 17 between the end points 16 of the intermediate section 13 and the polygon corner ends 14. It can furthermore be noted from FIG. 5 that the linear intermediate section 13 extends tangential to the adjacent end region of both convex flank sections 12. The corresponding tangent 18 forms in this connection an angle alpha of about 3.5° with the connecting lines 17.

The length y of the convexly extending flank section 11 is twice as great as the length x of the intermediate section 13. In the embodiment shown, a ratio between flank section 12 and intermediate section 13 of about 4:1 has been selected.

The distance between two parallel opposite flanks 11 of the solid polygon 5 is the distance across flats 51, which is adapted to that of the hexagon socket 6.

Figure 5:
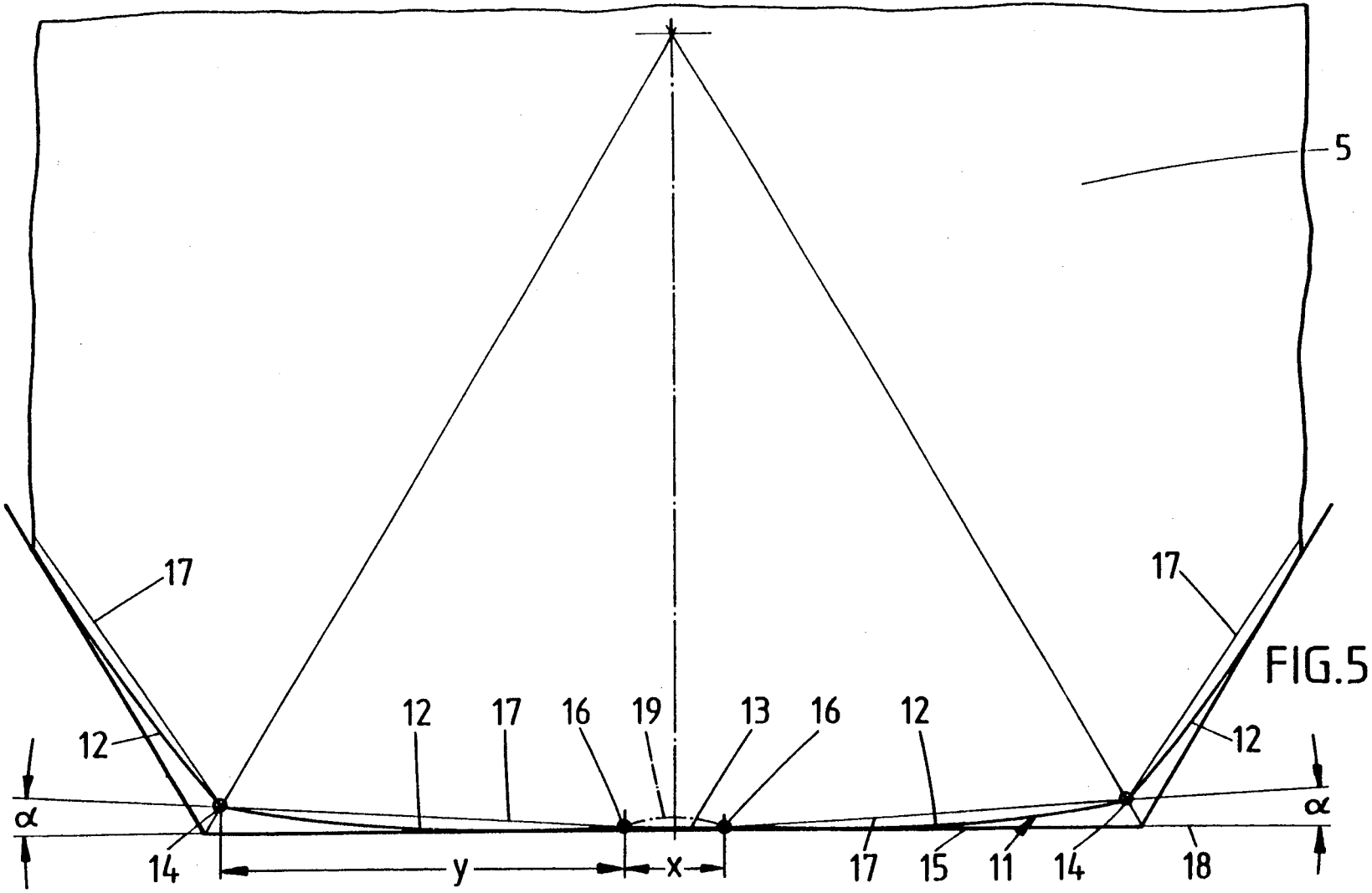
FIG. 5 shows, in a further enlarged view, a portion of the work end of the screwdriver.
Figure 6:
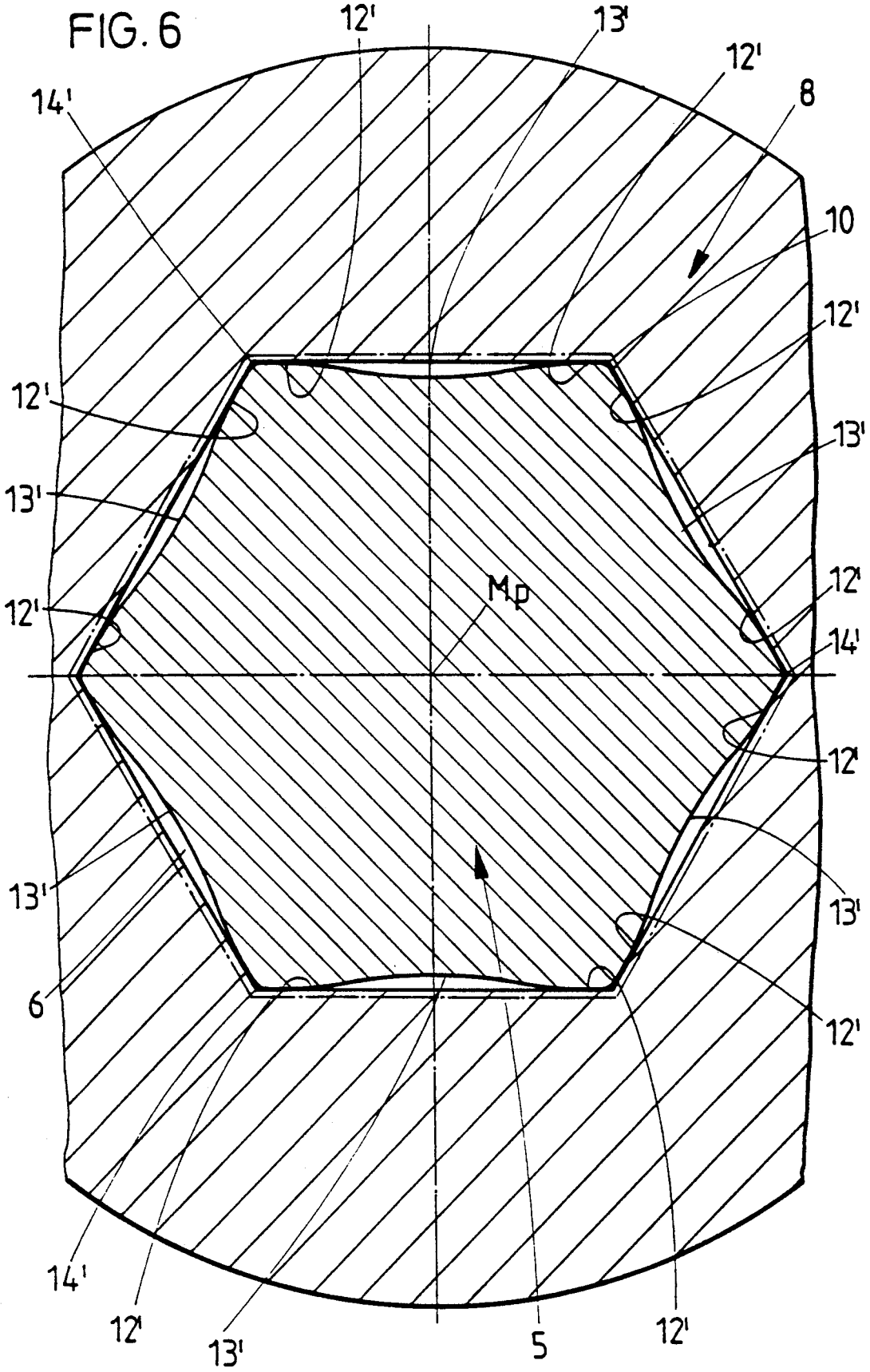
FIG. 6 shows, in a greatly enlarged view, a cross section through the screwhead with the working end of the screwdriver of a modified embodiment inserted in the polygon socket of the screwhead.
Figure 7:
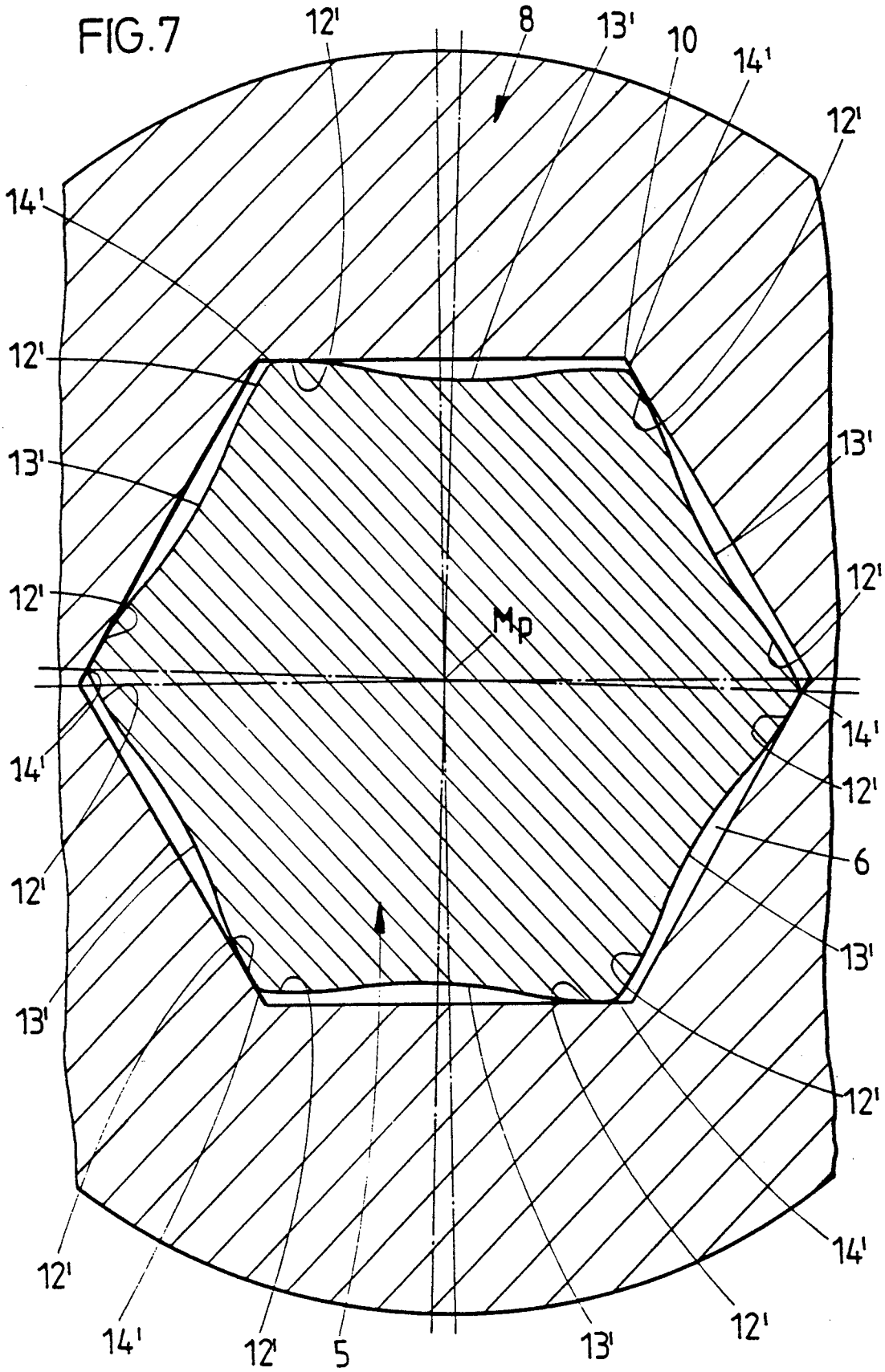
FIG. 7 is a view similar to FIG. 6 in driving position.
Figure 8:
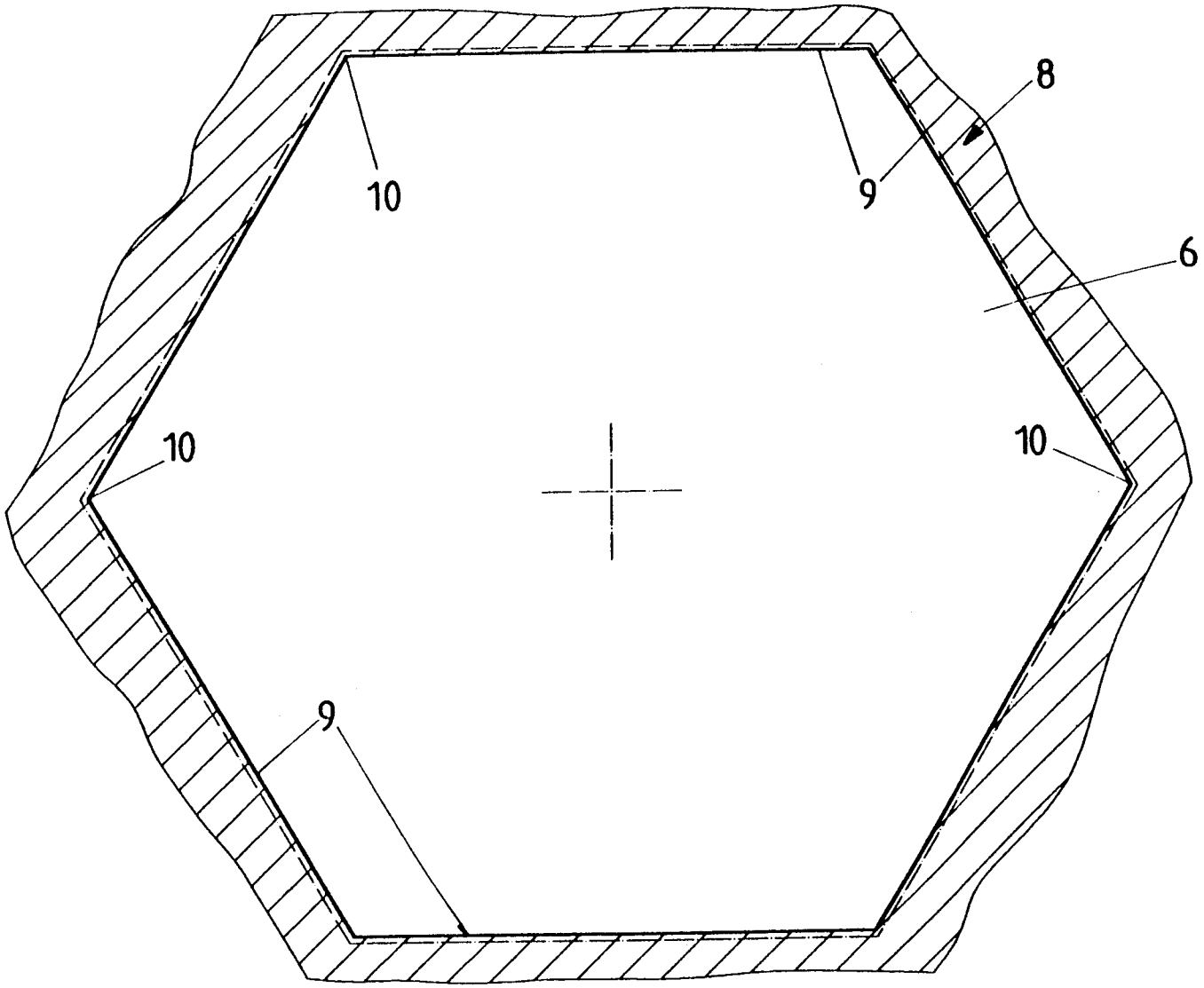
FIG. 8 is an enlarged view of the minimum/maximum tolerances of the polygon socket of a screw distance across flats 6.
Figure 9:
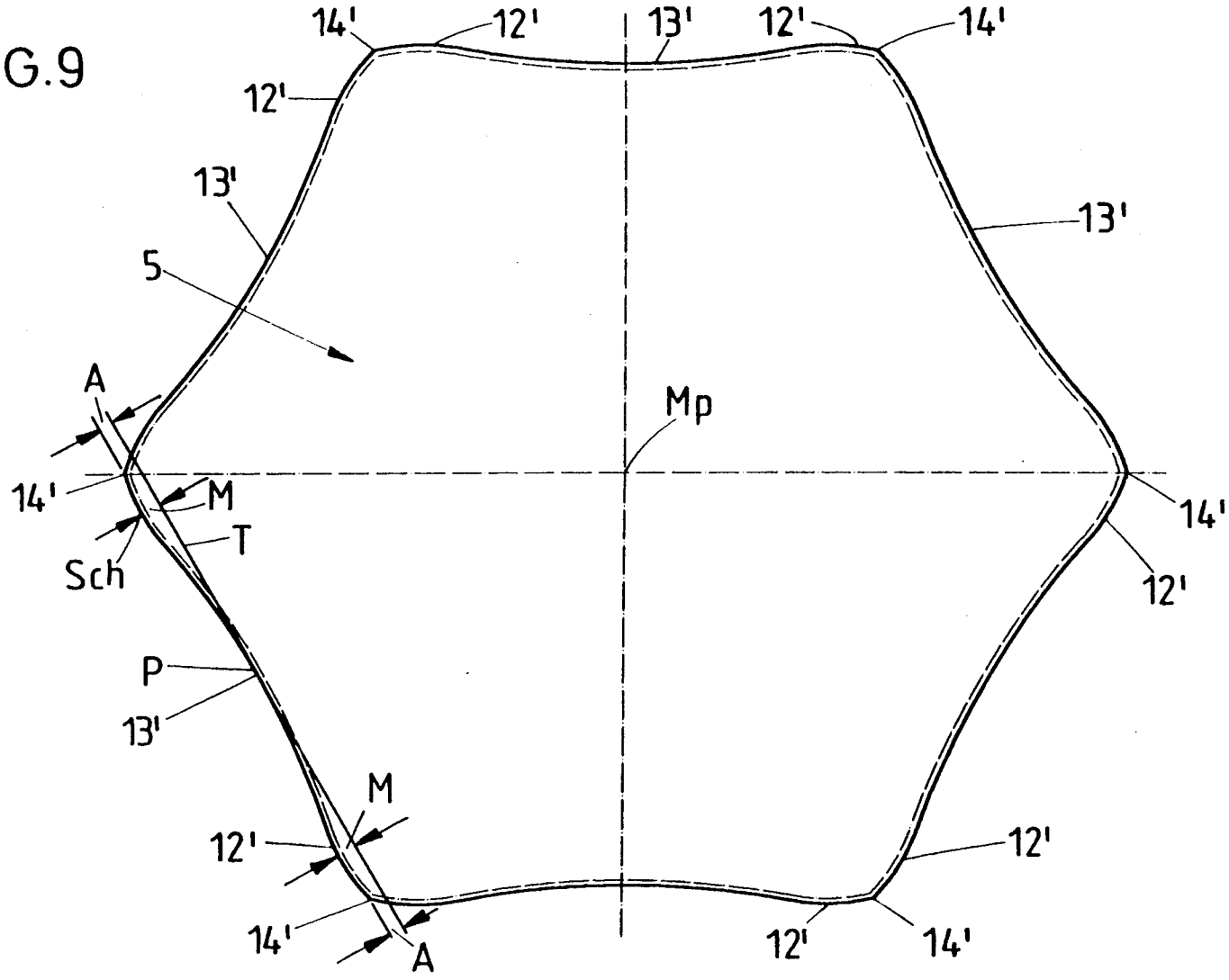
FIG. 9 is a view similar to FIG. 8 but referring to the working end (cross section) of the modified embodiment shown in FIG. 6, FIGS. 10 and 11 are an enlarged showing similar to FIG. 7 taking into account the (permissible) manufacturing tolerances of FIGS. 8 and 9 in the case of distance across flats 6, and, FIG. 12 is an enlarged view of a partial contour view showing the troughs of the centers of the arcs.

As indicated in dash-dot line in FIG. 5, it is possible to provide, within the region of the intermediate section 13, a recess 19 extending in the longitudinal direction of the shank, in order to receive diamond particles the outer surface of which forms the linear intermediate section 13. However, it is also possible to provide the working end itself with a coating of diamond particles.

Figure 4:
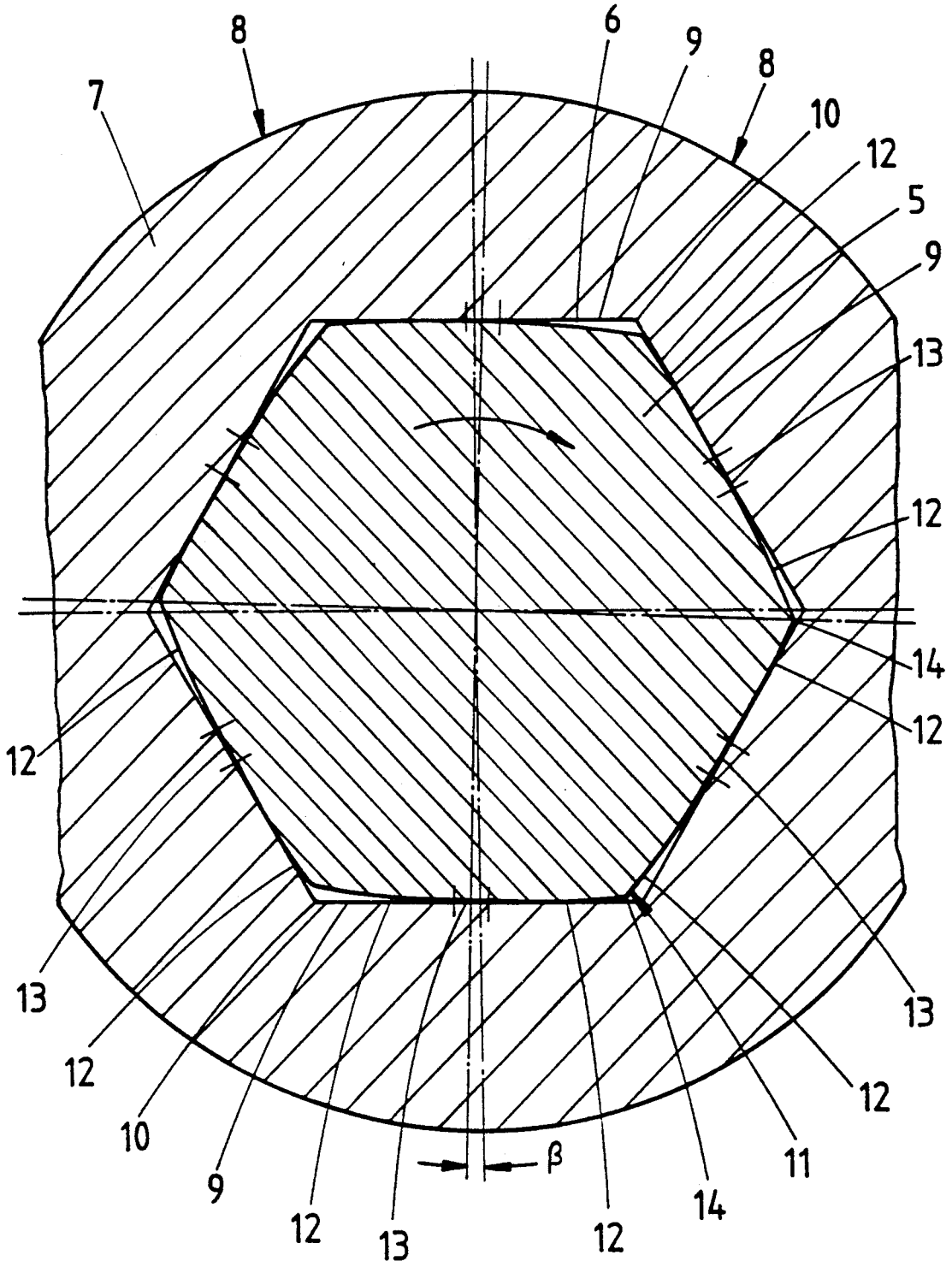
FIG. 4 is a cross section through the screwhead with the working end of the screwdriver inserted into its polygon socket, with the driving thereof in the direction indicated by the arrow.

If the screw 8, as shown in FIG. 4, is to be driven in the direction indicated by the arrow by the screwdriver 1, the solid hexagon 5, which represents the working end, must first be introduced into the hexagon socket 6 of the screwhead 7. The screwdriver 1 is then turned in the direction indicated by the arrow. In this connection, a slight relative turning by the angle beta takes place between the hexagon socket screw 8 and the solid polygon 5. Due to a certain deformation of the screwhead 7, there results an amply dimensioned resting surface between the hexagon socket surfaces 9 and the corresponding convex flank sections 12. In detail, the result is that practically a flank section 12 of each flank 11 as well as the intermediate section 13 or a large part of its length, come to rest against the hexagon socket surface 9 so that optimal torques can be transmitted. Due to the deformation on the screwhead, the resting surface is increased as the torque transmission becomes greater. As a result of this large resting surface a "cam-out effect" is also counteracted, so that the working end of the screwdriver 1 remains in form-locked connection with the hexagon socket screw 8 and does not jump or slide out of the hexagon socket 6.

FIGS. 6 to 12 show a modified embodiment. In this case, the non-convexly extending section 13, is concave. On both of its sides there are the convexly extending flank sections 12'.

Figure 10:
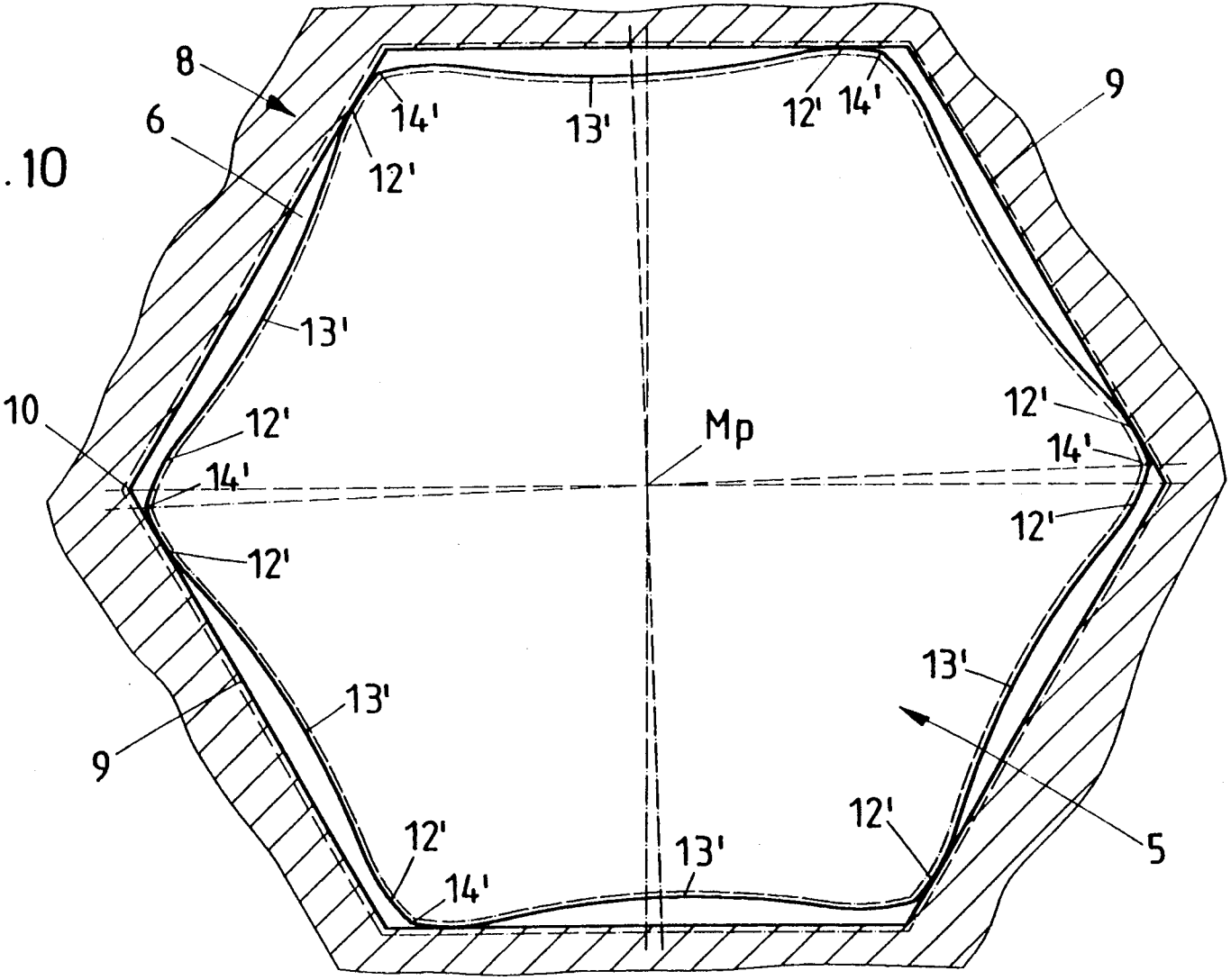
Figure 11:
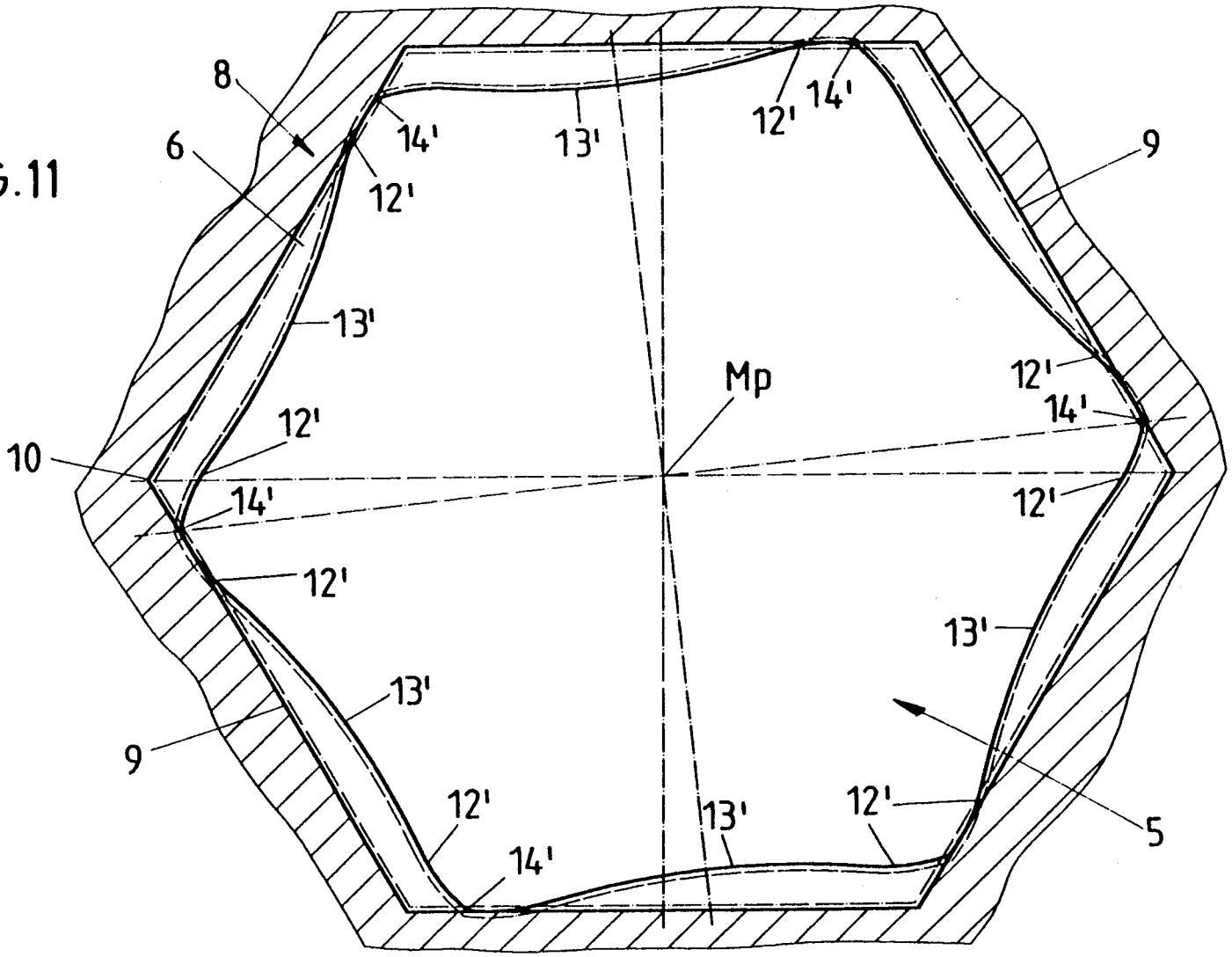

The polygon corner ends 14' lie —including any tolerances permitted in accordance with accepted manufacturing standards—at a normal distance A from the tangent T drawn to the lowest point P of the convex region. This distance A is smaller than the normal distance M of the peak Sch from this tangent T. FIGS. 10 and 11 show that, even in the event of random (unfavorable) addition of the tolerances, this embodiment still optimally incorporates the advantage that a digging edge contact is avoided and in particular, however, that the region of the transmission of the load lies at the largest possible lever arm from the polygon center Mp.

Figure 12:
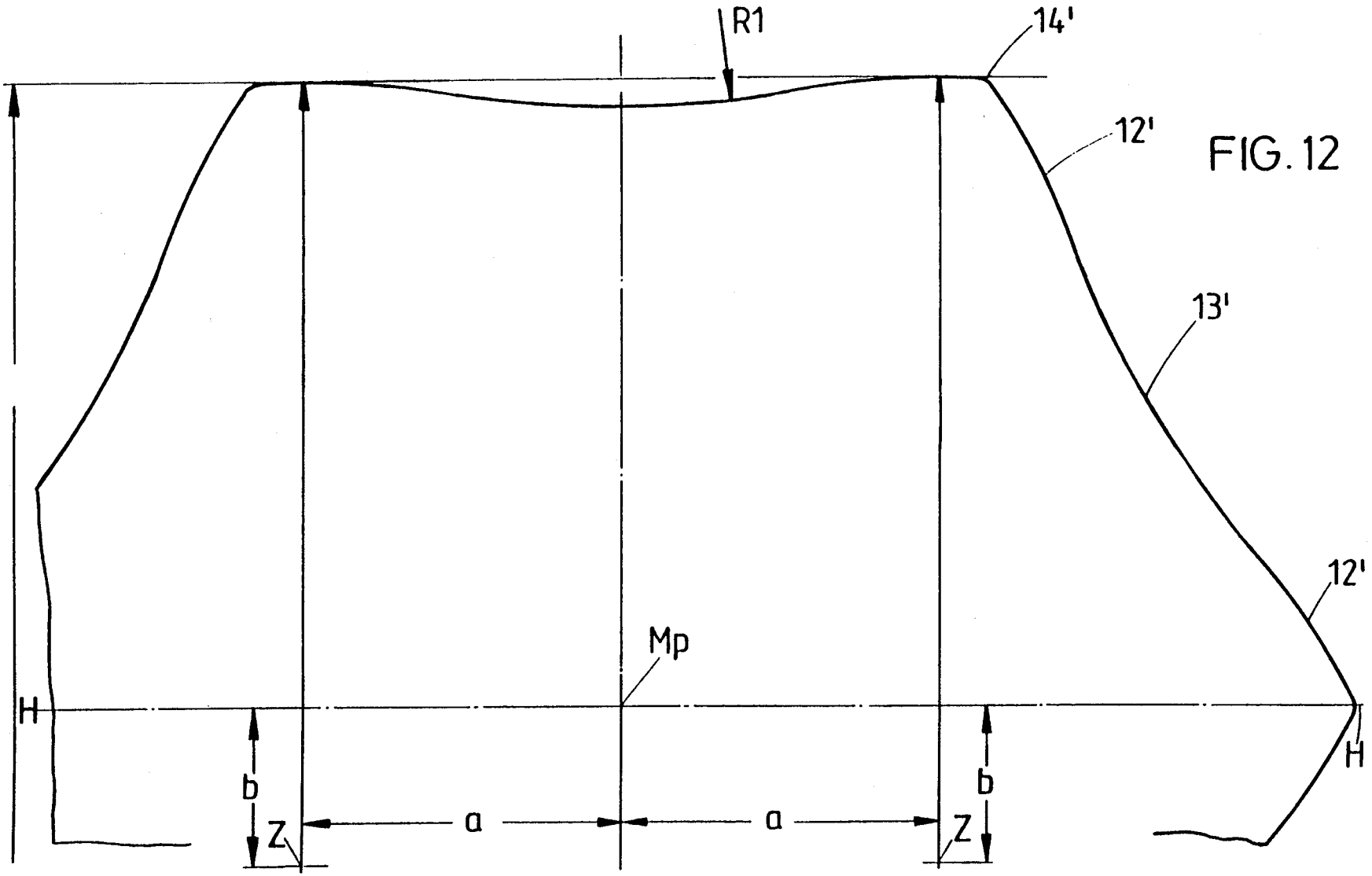

The work end of the screwdriver is shaped as the hexagon 5, is described by means of a main diameter H—H (FIG. 12) drawn between vertices of the flanks 11 (FIG. 1), and by means of an auxiliary diameter drawn as the perpendicular bisector of the main diameter. Each of the flank sections 12' is constructed as an arc about a center Z (as shown in FIG. 12) located on a side of the main diameter H—H opposite the arc, and on a side of the auxiliary diameter opposite the arc. The main diameter and the auxiliary diameter intersect at the center MP of the polygon, hexagon 5. The arc center Z for a specific arc is located at distances a and b (FIG. 12) respectively from the auxiliary diameter and the main diameter. The length of the distance a is approximately equal to ¼ of the length of the main diameter H—H.

We claim:

1. A polygonal screwing tool, particularly a screwdriver or screwdriver bit, for polygon socket screws, particularly hexagonal socket screws, the screwing tool comprising a plurality of flanks of similar configuration arranged circumferentially around a work end of the tool for engagement with a socket of a socket screw, successive ones of the flanks contacting each other; and wherein each of the flanks has an intermediate flank section and two convex flank sections disposed on opposite sides of the intermediate section and extending to opposed ends of the flank, the two convex sections of each flank having a curvature which extends in a circumferential path about the tool, a surface of the intermediate section of each flank being retracted from the circumferential path.

2. A polygonal screwing tool, particularly a screwdriver or screwdriver bit, for polygon socket screws, particularly hexagonal socket screws, the screwing tool comprising a plurality of flanks of similar configuration arranged circumferentially around the tool, successive ones of the flanks contacting each other; and wherein each of the flanks has a non-convexly extending intermediate flank section, and two convex flank sections disposed on opposite sides of the intermediate section and extending to the opposed ends of the flank.

3. A screwing tool according to claim 1, wherein a cross section of the work end of the tool has substantially the shape of a polygon, the flanks define edges of the polygon and the ends of the flanks define corners of the polygon and;

the polygon corners of the convexly extending flank sections are offset from a tangent to end points of the intermediate section.

4. A screwing tool according to claim 1, wherein the intermediate sections are linear.

5. A screwing tool according to claim 1, wherein the linear intermediate section is tangential to the adjacent end regions of both convex flank sections.

6. A screwing tool according to claim 1, wherein both of the convex flank sections and the intermediate sections are provided with a diamond-particle coating.

7. A screwing tool according to claim 1, wherein the intermediate section is concave.

8. A screwing tool according to claim 1, wherein in a flank, the length of the intermediate section corresponds approximately to the length of either convex flank section.

9. A screwing tool according to claim 3, wherein the polygon corners have a normal distance A from a tangent T to a point P of an intermediate section at a minimum diameter of the work end of the tool, the distance A being smaller than the distance of a peak point of a convex flank section from said tangent T.

10. A screwing tool according to claim 3, wherein a cross section of the work end of the tool has the shape of a polygon with a main diameter extending between a pair of opposed corners of the polygon, individual ones of said convex flank sections being described by an arc constructed about an arc center located at an offset distance measured from a perpendicular bisector of the main diameter, the offset distance being approximately equal to one half the main diameter.

* * * * *